US008231262B1

(12) United States Patent
Anderson et al.

(10) Patent No.: US 8,231,262 B1
(45) Date of Patent: Jul. 31, 2012

(54) EFFICIENCY OF HEAT TRANSFER AND THERMAL EXPANSION OF TUBULAR HEAT EXCHANGE MEMBERS IN AN INDIRECTLY HEATED ROTARY HEATER

(75) Inventors: Russell W. Anderson, Goshen, NY (US); Lawrence C. Hanlon, Naugatuck, CT (US); Gordon F. Martin, Jupiter, FL (US)

(73) Assignees: Russell W. Anderson, Goshen, NY (US); Lawrence C. Hanlon, Naugatuck, CT (US)

( * ) Notice: Subject to any disclaimer, the term of this patent is extended or adjusted under 35 U.S.C. 154(b) by 624 days.

(21) Appl. No.: 12/265,778

(22) Filed: Nov. 6, 2008

Related U.S. Application Data

(60) Provisional application No. 60/986,478, filed on Nov. 8, 2007.

(51) Int. Cl.
*B28C 5/46* (2006.01)

(52) U.S. Cl. ..... 366/25; 366/54; 241/67

(58) Field of Classification Search ..... 366/25, 366/54; 241/67
See application file for complete search history.

(56) References Cited

U.S. PATENT DOCUMENTS 2,223,688 A * 12/1940 Jabelmann ..... 165/11.1
3,749,082 A * 7/1973 Brock ..... 126/343.5 A
5,188,299 A 2/1993 Hendrickson et al.
5,294,062 A 3/1994 Hendrickson et al.
5,520,342 A 5/1996 Hendrickson et al.
* cited by examiner

*Primary Examiner* — Joseph Del Sole
*Assistant Examiner* — James Sanders
(74) *Attorney, Agent, or Firm* — Arthur Jacob

(57) ABSTRACT

Recycled asphalt product is heated within an indirectly heated recycled asphalt product heater by passing heated gases through heat exchange members within a drum while the recycled asphalt product is moved through the drum from one end to the other end of the drum. The heat exchange members provide conduits for the heated gases, the conduits extending from an inlet adjacent a source of heated gases to an outlet communicating with an exhaust, each conduit following a looped path and having two or more segments each with a longitudinal length extending from adjacent one end of the drum to adjacent the other end of the drum. The segments are arranged serially in a serpentine configuration, are generally parallel to one another, and are spaced apart radially within the interior of the drum. Each inlet is coupled with the source of heated gases for longitudinal movement of the inlet relative to the drum along an inlet site adjacent the source of heated gases, and each outlet is connected to the drum for affixing the outlet against longitudinal movement relative to the drum at an outlet site adjacent one of the ends of the drum. The configuration and orientation of the conduits enable longitudinal expansion and contraction of the conduits in response to heating and cooling of the conduits, while the outlets remain essentially stationary at the outlet site.

12 Claims, 5 Drawing Sheets

EFFICIENCY OF HEAT TRANSFER AND THERMAL EXPANSION OF TUBULAR HEAT EXCHANGE MEMBERS IN AN INDIRECTLY HEATED ROTARY HEATER

This application claims the benefit of provisional application Ser. No. 60/986,478, filed Nov. 8, 2007.

The present invention relates generally to the production of asphalt paving materials, and especially to those materials consisting primarily of recycled asphalt product (RAP), and pertains, more specifically, to improvements in apparatus and method for increasing the effectiveness and efficiency of heat transfer within an indirectly heated rotary heater, as well as the long-term performance of the heater.

Unlike conventional direct heated asphalt product plants, in which the asphalt product being processed can come into contact with the flame of a burner or with hot combustion gases that provide heat for processing the product, an indirectly heated asphalt product heater accomplishes heating of the asphalt product by means of conduction, convection and radiation of heat from tubular heat exchange members heated internally by hot gases heated by a burner flame and passed through the heat exchange members, thereby avoiding direct contact between the asphalt material being processed and the burner flame, and the hot gases relied upon for heating the material being processed. As an additional, optional measure, the drum within which the asphalt material is processed may be provided with a passage through which the heated gases are passed for conducting further heat to the material being processed, while precluding direct contact between the hot gases and the material.

Heaters of the type described above and used in connection with indirectly heating recycled asphalt produce (RAP) are fully disclosed in U.S. Pat. Nos. 5,188,299, 5,294,062 and 5,520,342, the disclosures of all of which patents are incorporated herein by reference thereto.

In such indirectly heated rotary heaters and, in particular, in an indirectly heated recycled asphalt product (RAP) heater, the amount of heat transferred to the product and, therefore, product tonnage throughput, is directly proportional to the surface area provided for radiant heat. Accordingly, increased effectiveness and efficiency can be attained by increasing the surface area from which heat is radiated. In addition, due to the great amount of thermal expansion and contraction of the tubular heat exchange members experienced during operation of the rotary heater, it becomes important from the standpoint of reliability and long-term performance to accommodate such expansion and contraction.

The present invention provides improvements toward increasing the surface area from which heat is transferred to product within an indirectly heated asphalt product heater of the type described above, and for accommodating expansion and contraction of the tubular heat exchange members of such a heater during operation of the heater. As such, the present invention attains several objects and advantages, some of which are summarized as follows: Increases the overall efficiency of an indirectly heated rotary heater in processing an asphalt product through the heater, with a concomitant increase in product throughput; provides an increase in the area from which heat is transferred from tubular heat exchange members within an indirectly heated rotary heater for processing an asphalt material, with a concomitant increase in effectiveness and efficiency of heat transfer; enables the effective transfer of greater amounts of heat to product being processed within an indirectly heated rotary heater, without the necessity for increasing the overall size and dimensions of the heater; compensates for thermal expansion and contraction of the tubular heat exchange members of an indirectly heated rotary asphalt product heater resulting from heating and cooling of the members during cycles of operation of the heater; enables a high degree of reliability as well as increased effectiveness during use of an indirectly heated rotary asphalt product heater; provides reliable performance over an extended service life.

The above objects and advantages, as well as further objects and advantages, are attained by the present invention which may be described briefly as providing, in an indirectly heated asphalt product heater wherein asphalt product is moved longitudinally along the interior of a drum from one to another of longitudinally opposite first and second ends of the drum, the drum having a drum wall, and heated gases are conducted, through heat exchange members, from a source of heated gases to an exhaust, each located respectively adjacent a corresponding end of the drum, the heat exchange members extending longitudinally along the interior of the drum between the opposite ends of the drum for isolating the heated gases from the interior of the drum, and consequently from the asphalt product in the drum, while providing heat to the asphalt product within the drum, the improvement wherein the heat exchange members comprise: a conduit for conducting heated gases from the source of heated gases toward the exhaust, the conduit having an inlet communicating with the source of heated gases and an outlet communicating with the exhaust, the conduit following a looped path and having longitudinally extending segments along the looped path, each segment having a longitudinal length extending from adjacent the first end of the drum to adjacent the second end of the drum for providing heat along the interior of the drum; an inlet coupler coupling the inlet with the source of heated gases for longitudinal movement of the inlet relative to the drum along an inlet site adjacent the source of heated gases; and an outlet connector connecting the outlet to the drum for affixing the outlet against longitudinal movement relative to the drum at an outlet site adjacent one of the first and second ends of the drum; the conduit being dimensioned, configured and oriented for enabling longitudinal expansion and contraction of the conduit along the longitudinal length of each segment in response to heating and cooling of the conduit, while the outlet remains essentially stationary at the outlet site.

In addition, the present invention provides, in an indirectly heated asphalt product heater wherein asphalt product is moved longitudinally along the interior of a drum from one to another of longitudinally opposite ends of the drum, the drum having a generally cylindrical drum wall, and heated gases are conducted, through heat exchange members, from a source of heat to an exhaust, each located respectively adjacent a corresponding end of the drum, the heat exchange members extending longitudinally along the interior of the drum between the opposite ends of the drum for isolating the heated gases from the interior of the drum, and consequently from the asphalt product in the drum, while providing heat to the asphalt product within the drum, the improvement wherein the heat exchange members comprise: a conduit for conducting heated gases from the source of heated gases toward the exhaust, the conduit having an inlet communicating with the source of heated gases and an outlet communicating with the exhaust, the conduit following a looped path and having serial segments, each segment having a longitudinal length extending from adjacent the one end of the drum to adjacent an opposite end of the drum, the segments being arranged consecutively in a serpentine configuration wherein first and second consecutive ones of the segments are generally parallel to one another along the interior of the drum, and are spaced apart radially from one another within the interior of the drum.

Further, the present invention provides a method for heating asphalt product in an indirectly heated asphalt product heater wherein the asphalt product is moved longitudinally along the interior of a drum from one to another of longitudinally opposite first and second ends of the drum, the drum having a drum wall, and heated gases are conducted, through heat exchange members, from a source of heated gases to an exhaust, each located respectively adjacent a corresponding end of the drum, the heat exchange members extending longitudinally along the interior of the drum between the opposite ends of the drum for isolating the heated gases from the interior of the drum, and consequently from the asphalt product in the drum, while providing heat to the asphalt product within the drum, the method comprising: conducting heated gases within a conduit in a heat exchange member, from the source of heated gases toward the exhaust, the conduit having an inlet communicating with the source of heat and an outlet communicating with the exhaust, the conduit following a looped path and having longitudinally extending segments along the looped path, each segment having a longitudinal length extending from adjacent the first end of the drum to adjacent the second end of the drum for providing heat along the interior of the drum; coupling the inlet with the source of heated gases for longitudinal movement of the inlet relative to the drum along an inlet site adjacent the source of heated gases; connecting the outlet with the drum for affixing the outlet against longitudinal movement relative to the drum at an outlet site adjacent one of the first and second ends of the drum; and dimensioning, configuring and orienting the conduit for enabling longitudinal expansion and contraction of the conduit along the longitudinal length of each segment in response to heating and cooling of the conduit, while the outlet remains essentially stationary at the outlet site.

In addition, the present invention provides a method for heating asphalt product in an indirectly heated asphalt product heater wherein the asphalt product is moved longitudinally along the interior of a drum from one to another of longitudinally opposite ends of the drum, the drum having a generally cylindrical drum wall, and heated gases are conducted, through heat exchange members, from a source of heated gases to an exhaust, each located respectively adjacent a corresponding end of the drum, the heat exchange members extending longitudinally along the interior of the drum between the opposite ends of the drum for isolating the heated gases from the interior of the drum, and consequently from the asphalt product in the drum, while providing heat to the asphalt product within the drum, the method comprising: conducting heated gases within a conduit in a heat exchange member, from the source of heated gases toward the exhaust, the conduit having an inlet communicating with the source of heated gases and an outlet communicating with the exhaust, the conduit following a looped path and having serial segments, each segment having a longitudinal length extending from adjacent the one end of the drum to adjacent an opposite end of the drum, the segments being arranged consecutively in a serpentine configuration wherein first and second consecutive ones of the segments are generally parallel to one another along the interior of the drum, and are spaced apart radially from one another within the interior of the drum.

The invention will be understood more fully, while still further objects and advantages will become apparent, in the following detailed description of preferred embodiments of the invention illustrated in the accompanying drawing, in which.

Figure 1:
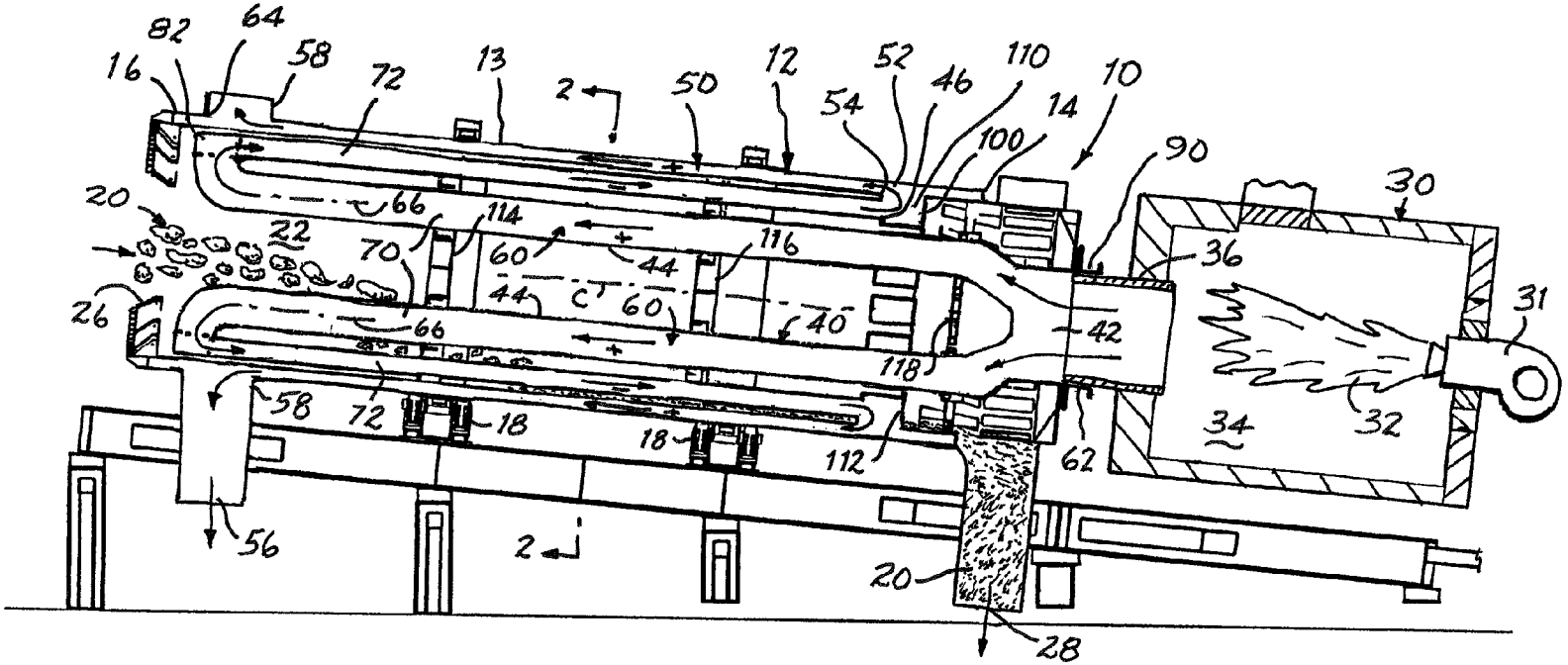
FIG. 1 is a largely diagrammatic, longitudinal cross-sectional view of an indirectly heated recycled asphalt product (RAP) heater constructed in accordance with the present invention and incorporating improvements of the present invention.
Figure 2:
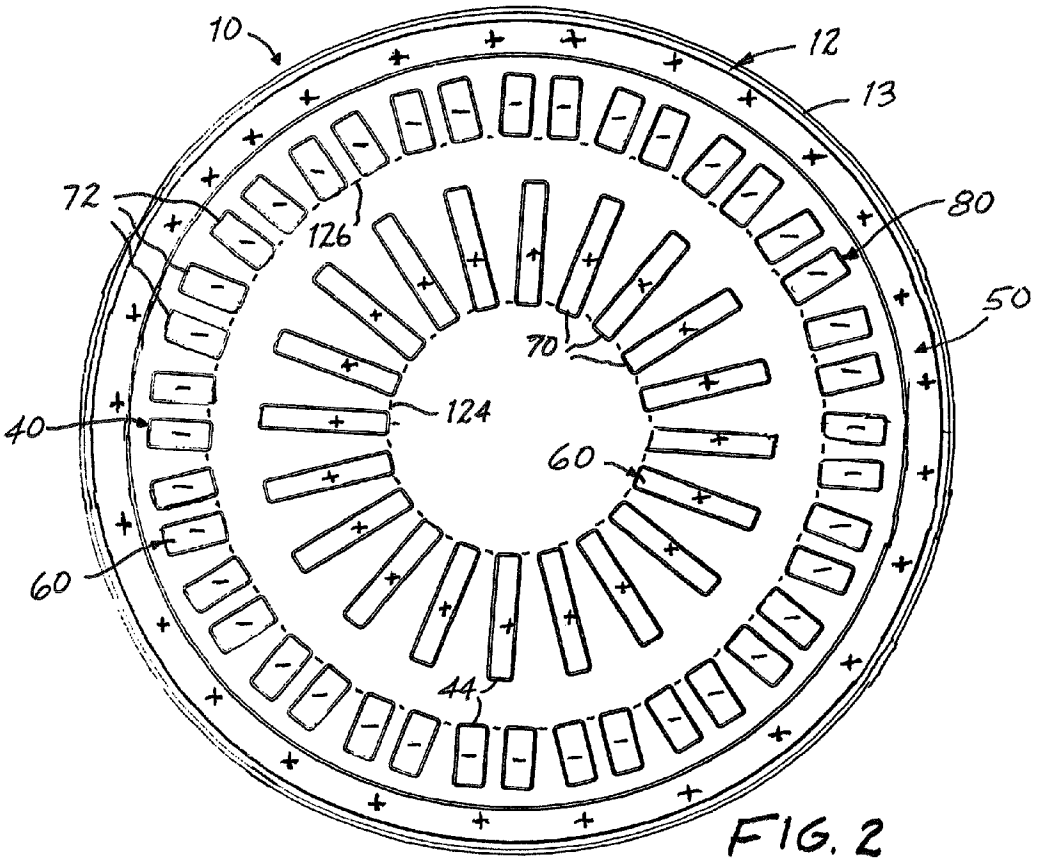
FIG. 2 is an enlarged largely diagrammatic transverse cross-sectional view taken along line 2-2 of FIG. 1.

Referring now to the drawing, and especially to FIGS. 1 and 2 thereof, an indirectly heated asphalt product heater is shown in the form of an indirectly heated recycled asphalt product (RAP) heater depicted largely diagrammatically at 10 and is seen to include an elongate drum 12 having a wall 13 extending longitudinally between a first end 14 and an opposite second end 16. Drum 12 is mounted for rotation about a central axis C by means of roller assemblies 18 and is inclined at a relatively small angle of inclination such that the second end 16 is elevated relative to the first end 14, the angle of inclination being sufficient for the purposes to be described. Recycled asphalt product (RAP) to be processed is introduced into the drum 12 adjacent second end 16 and is shown in the form of material 20 which is moved into the interior 22 of the drum 12 at an entrance location 26 adjacent the second end 16. As described more fully in the aforesaid U.S. Pat. Nos. 5,188,299, 5,294,062 and 5,520,342, which patents are incorporated herein by reference thereto, material 20 moves longitudinally along the interior 22 of the drum 12 from the second end 16 toward the first end 14 by virtue of the inclination and rotation of the drum 12 and, as the material 20 moves along the drum 12, the material 20 is heated, while larger pieces of the material 20 are broken to a reduced size, so that processed RAP is delivered to and discharged at a discharge location 28, down from the entrance location 26, and adjacent the first end 14, with the processed RAP having a desired consistency and temperature.

Heating of the material 20 is accomplished by heat transferred from gases at an elevated temperature passed from a source of heated gases through a heat exchange arrangement which is heated internally by the heated gases and which is contacted externally by the material 20 as the material moves along the drum 12 from the second end 16 toward the first end 14. In the illustrated embodiment, the source 30 of heated gases includes a burner 31 which directs a flame 32 into a combustion chamber 34 to generate heated gases which are passed through an internal transition tube 36 to enter a heat exchange arrangement 40 at an inlet site 42, adjacent the first end 14 of the drum 12. Heat exchange arrangement 40 includes a plurality of tubular heat exchange members 44 extending longitudinally and arrayed about the axis of rotation C of the drum 12 such that upon rotation of the drum 12, the material 20 will be heated by the conduction of heat from the tubular heat exchange members 44 as the material 20 contacts the tubular heat exchange members 44, as well as by convection and radiation of heat emanating from the heat exchange arrangement 40 and from the drum 12 itself. At the same time, the tubular heat exchange members 44 serve as breaker bars which break down larger pieces of the material 20 as the material 20 progresses along the drum 12. The heated gases continue through the heat exchange arrangement 40 to an outlet 46 and, in the illustrated embodiment, enter a passage in the wall 13 of drum 12, shown in the form of a peripheral jacket 50, at a jacket inlet 52 placed at a location 54 adjacent the first end 14 of the drum 12. The jacket 50 extends longitudinally along the drum 12 and is dimensioned and configured, and communicates with the tubular heat exchange members 44 at the outlet 46 and the jacket inlet 52, for conducting the heated gases from adjacent the first end 14 of the drum toward the second end 16 and to an exhaust 56 at an exhaust manifold 58, thereby providing additional heat to the material 20 within the drum 12, in a manner similar to that described more fully in the aforesaid prior patents.

In order to increase the effectiveness and efficiency of the transfer of heat to the material 20 as the material 20 moves longitudinally along the interior 22 of the drum 12, each tubular heat exchange member 44 provides a conduit 60 for conducting the heated gases from the source 30 of heated gases toward the exhaust 56, each conduit 60 communicating with the source 30 of heated gases at an inlet 62 adjacent the inlet site 42 and communicating, through jacket 50, with the exhaust 56 at an outlet 64. Each conduit 60 follows a looped path 66 and has longitudinally extending segments, shown in the form of first and second segments 70 and 72, respectively, which extend along the looped path 66 and preferably are spaced laterally away from the drum wall 13. Each segment 70 and 72 has a longitudinal length which extends from adjacent the first end 14 of the drum 12 to adjacent the second end 16 of the drum 12 for providing heat along the interior 22 of the drum 12.

The segments 70 and 72 are arranged so that at least one second segment 72 extends serially with respect to a corresponding first segment 70 and in a serpentine configuration wherein the two segments 70 and 72 are generally parallel to one another along the interior 22 of the drum 12 and are spaced apart radially within the interior 22 of the drum 12. In the illustrated embodiment, each conduit 60 includes two second segments 72, each arranged serially with a common first segment 70. In the preferred construction, the plural tubular heat exchange members 44 are arranged in a cylindrical array 80 and provide multiple conduits 60 and corresponding multiple looped paths 66. Each tubular heat exchange member 44 communicates with an annular manifold 82 located adjacent the second end 16 of the drum 12. The heated gases follow looped paths 66 in a first direction within first segments 70 from the first end 14 toward the second end 16 of the drum 12, indicated by a plus (+) arrow, and then reverse direction within the manifold 82 to proceed in an opposite second direction within second segments 72 from the second end 16 toward the first end 14 of the drum 12, indicated by a minus (−) arrow. Thus, the serpentine configuration provided by the plural segments establishes increased areas along each conduit 60 and within the interior 22 of the drum 12 for the transfer of heat to the interior 22 of the drum 12 from the heated gases traversing the looped path 66.

An inlet coupler 90 couples the inlet 62 with the source 30 of heated gases, the inlet coupler 90 being located at the inlet site 42 adjacent the source 30 of heated gases. The inlet site 42 is shown placed at transition tube 36 and the inlet coupler 90 enables sliding movement of the inlet 62 relative to the transition tube 36 in longitudinal directions along the transition tube 36. An outlet connector in the form of an annular manifold 100 connects the outlets 46 with the drum 12 at drum wall 13, the manifold 100 being located at an outlet site 110 adjacent the first end 14 of the drum 12. The manifold 100 is fixed in place, as by a flange 112 which secures the outlets 46 at the outlet site 110. Supplemental supports 114, 116 and 118 engage and support the tubular heat exchange members 44 at corresponding spaced apart locations along the length of the tubular heat exchange members 44; however, the engagement is a slip-type engagement which permits longitudinal movement of the tubular heat exchange members 44 relative to the supports 114, 116 and 118. Thermal expansion and contraction of the tubular heat exchange members 44 in longitudinal directions in response to the extreme temperature differentials to which the tubular heat exchange members 44 are exposed during operation of the heater 10 and during cool down subsequent to operation thus is enabled, while the connection at the outlet site 110 remains stationary and intact.

In the embodiment of FIGS. 1 and 2, the outlets 46 are connected to the wall 13 of the drum 12 at the jacket inlet 52 such that the heated gases, upon exiting each conduit 60 at a corresponding outlet 46, travel through a further conduit provided by the jacket 50 to the exhaust manifold 58, and provide further heat to the interior 22 of the drum 12. The fixed connection at manifold 100 assures that an appropriate seal is maintained at the connection so that the heated gases are conducted effectively from each conduit 60 provided by the tubular heat exchange members 44 to the further conduit provided by the jacket 50.

In the illustrated embodiment of FIGS. 1 and 2, the second segments 72, by virtue of their location and arrangement with respect to first segments 70, have a configuration and dimensions different from the configuration and dimensions of first segments 70. Thus, the first segments 70 are located and spaced apart circumferentially along a first circle 124 in the cylindrical array 80, and the second segments 72 are located downstream of the first segments 70 and are spaced apart circumferentially along a second circle 126 in the cylindrical array 80. The cylindrical array 80 preferably is spaced radially inwardly away from the drum wall 13, and the first circle 124 has a diameter smaller than the diameter of the second circle 126 such that the first segments 70 are spaced radially inwardly away from the second segments 72, while the second segments 72 are spaced radially inwardly away from the drum wall 13. Since the tubular heat exchange members 44 are affixed to the wall 13 of the drum 12 only at the outlet site 110, any differential in thermal expansion or contraction between the segments 70 and 72, in longitudinal directions, due to the differences in configuration and dimensions is accommodated through longitudinal movement of the segments 70 and 72 relative to the drum 12, as permitted by the sliding movement of the tubular heat exchange members 44 relative to drum 12, while the connection at outlet site 110 remains stationary.

Figure 3:
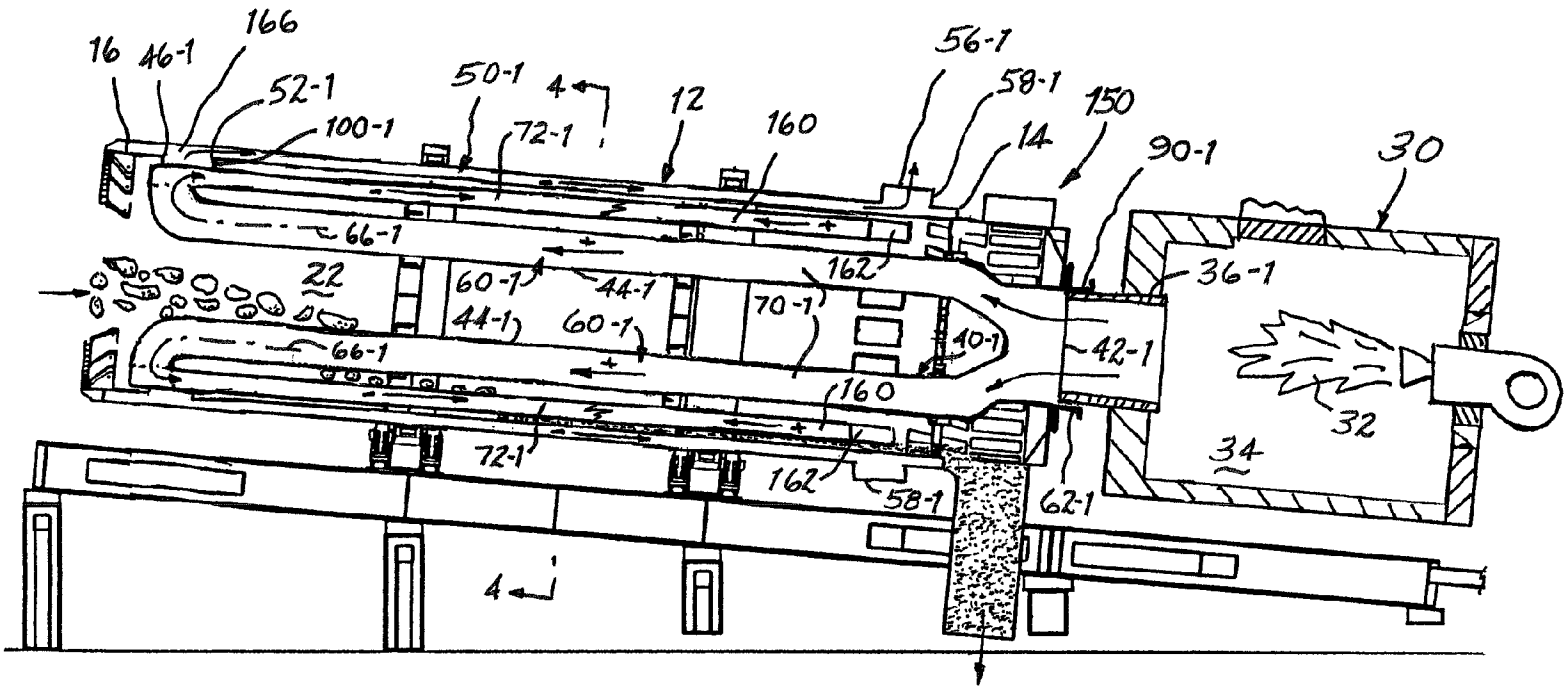
FIG. 3 is a largely diagrammatic, longitudinal cross-sectional view of another indirectly heated recycled asphalt product (RAP) heater constructed in accordance with the present invention and incorporating improvements of the present invention.
Figure 4:
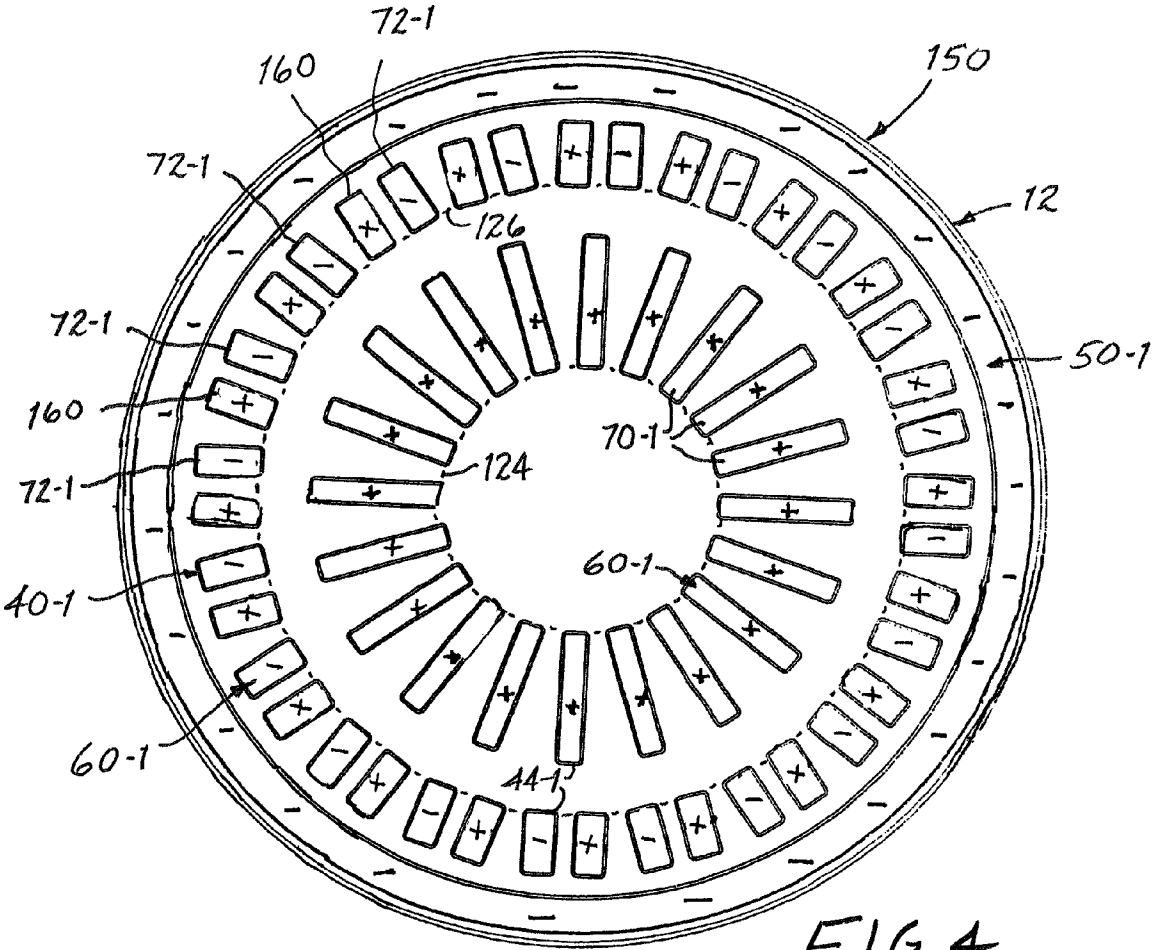
FIG. 4 is an enlarged largely diagrammatic transverse cross-sectional view taken along line 4-4 of FIG. 3.

Turning now to FIGS. 3 and 4, another indirectly heated RAP heater constructed in accordance with the invention is depicted largely diagrammatically at 150. Heater 150 is constructed and operates in a manner similar to heater 10 described above, and like reference characters are employed to identify like component parts of both heaters 10 and 150. However, in order further to increase the effectiveness and efficiency of the transfer of heat from the heated gases to the interior 22 of the drum 12, the tubular heat exchange members 44-1 of heat exchange arrangement 40-1 are modified such that the overall length of the looped path 66-1 provided for the heated gases within each conduit 60-1 is increased over the length of looped path 66 provided by each conduit 60 of heater 10, thereby increasing the residence time of the heated gases within the drum 12 as the gases traverse the conduits 60-1 from inlets 62-1 to outlets 46-1. Thus, each conduit 60-1 is provided with a third segment 160 generally parallel to first and second segments 70-1 and 72-1 and having a longitudinal length extending from adjacent the first end 14 of the drum 12 to adjacent the second end 16 of the drum 12. Each third segment 160 is connected to and communicates with a corresponding second segment 72-1 at a connector elbow 162 located adjacent first end 14 of the drum 12 such that the heated gases are conducted along an extended serpentine configuration, lengthened by the addition of the third segment 160 along the looped path 66-1, in a direction which is the reverse of the direction followed in the second segment 72-1, as indicated by a plus (+) arrow placed within the third segment 160. An outlet connector in the form of an annular manifold 100-1 connects the outlet 46-1 of each conduit 60-1 to the wall 13 of the drum 12 at a jacket inlet 52-1, at an outlet site 166 located adjacent the second end 16 of the drum 12, and the heated gases are passed into a jacket 50-1 to proceed to an exhaust manifold 58-1 to be exhausted at exhaust 56-1 located adjacent first end 14 of the drum 12. As best seen in FIG. 4, the third segments 160 are located along the second circle 126, each placed between adjacent second segments 72-1, and are spaced circumferentially from adjacent second segments 72-1. With the fixed connections at the outlet site 166 and the slip-type engagement provided by coupler 90-1 along transition tube 36-1 at the inlet site 42-1, thermal expansion and contraction of the conduits 60-1 is accommodated in the manner described above.

Figure 5:
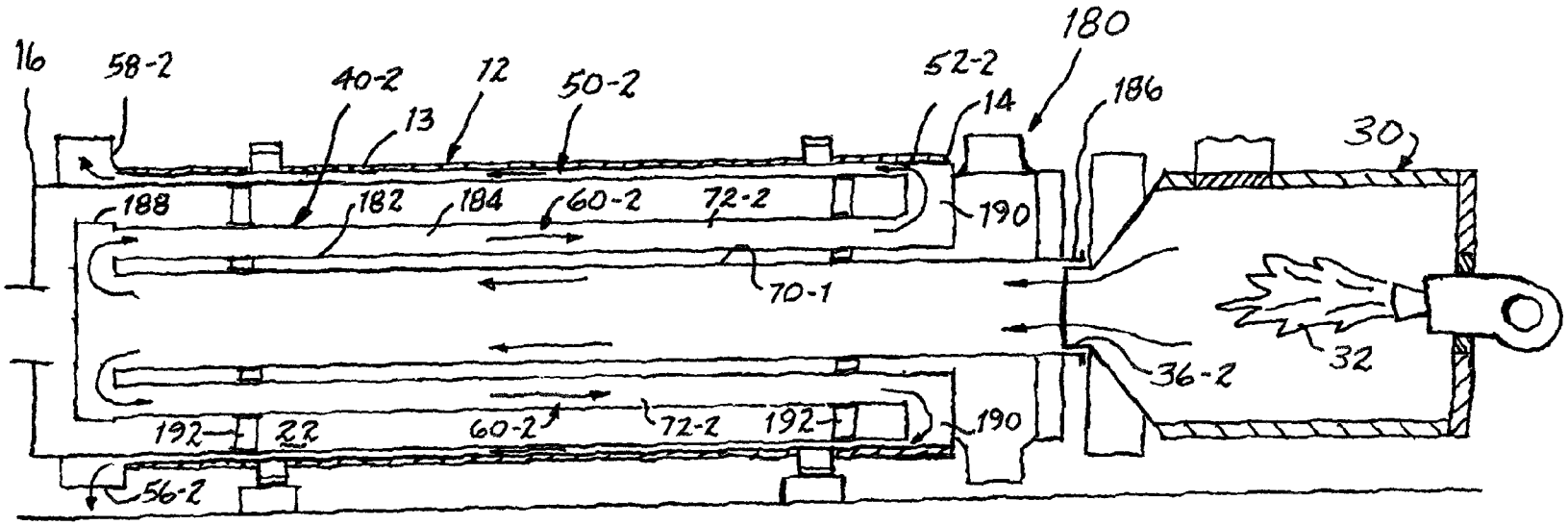
FIG. 5 is a largely diagrammatic, longitudinal cross-sectional view of still another indirectly heated recycled asphalt product (RAP) heater constructed in accordance with the present invention and incorporating improvements of the present invention.

Referring now to FIG. 5, still another indirectly heated RAP heater constructed in accordance with the present invention is depicted largely diagrammatically at 180. Heater 180 is constructed and operates in a manner similar to heater 10 described above, and like reference characters are employed to identify like component parts of both heaters 10 and 180. In heater 180, each conduit 60-2 includes second segments 72-2; however, first segments 70 of heater 10 are replaced by a single central tubular member 182 providing a single first segment 70-2 common to multiple second segments 72-2 provided by peripheral tubular members 184 in a parallel array communicating with each of the multiple second segments 72-2. Heated gases from source 30 are passed through a transition tube 36-2 to enter the tubular member 182 which is coupled with the transition tube 36-2 by a slip-type coupler 186. The heated gases then proceed from the first segment 70-2 to the second segments 72-2, at a manifold 188, adjacent second end 16 of the drum 12, and then through the second segments 72-2 to jacket inlet 52-2 where a fixed connector in the form of an annular manifold 190 connects each tubular member 184 and, thus, each conduit 60-2 to the wall 13 of drum 12, and secure the heat exchange arrangement 40-2 to the drum 12 adjacent the first end 14 of the drum 12. The heated gases then travel along jacket 50-2 to an exhaust manifold 58-2 to be exhausted through exhaust 56-2, located adjacent second end 16 of drum 12. In the embodiment of FIG. 5, the surface area of the exterior of central tubular member 182 provides for effective heat transfer, and the parallel array of peripheral tubular members 184 serve as breaker bars, as well as for the transfer of heat to the interior 22 of the drum 12. Supplemental slip-type supports 192, as well as slip-type coupler 186, support the heat exchange arrangement 40-2 within the interior 22 of drum 12 and, in concert with the fixed connection at annular manifold 190, accommodate thermal expansion and contraction of the segments 70-2 and 72-2 as described above.

It will be seen that the present invention provides an improvement which attains all of the objects and advantages summarized above, namely: Increases the overall efficiency of an indirectly heated rotary heater in processing an asphalt product through the heater, with a concomitant increase in product throughput; provides an increase in the area from which heat is transferred from tubular heat exchange members within an indirectly heated rotary heater for processing an asphalt material, with a concomitant increase in effectiveness and efficiency of heat transfer; enables the effective transfer of greater amounts of heat to product being processed within an indirectly heated rotary heater, without the necessity for increasing the overall size and dimensions of the heater; compensates for thermal expansion and contraction of the tubular heat exchange members of an indirectly heated rotary asphalt product heater resulting from heating and cooling of the members during cycles of operation of the heater; enables a high degree of reliability as well as increased effectiveness during use of an indirectly heated rotary asphalt product heater; provides reliable performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. In an indirectly heated asphalt product heater wherein asphalt product is moved longitudinally along the interior of a drum from one to another of longitudinally opposite first and second ends of the drum, the drum having a drum wall, and heated gases are conducted, through heat exchange members, from a source of heated gases to an exhaust, each located respectively adjacent a corresponding end of the drum, the heat exchange members extending longitudinally along the interior of the drum between the opposite ends of the drum for isolating the heated gases from the interior of the drum, and consequently from the asphalt product in the drum, while providing heat to the asphalt product within the drum, the improvement wherein the heat exchange members comprise:

a conduit for conducting heated gases from the source of heated gases toward the exhaust, the conduit having an inlet communicating with the source of heated gases and an outlet communicating with the exhaust, the conduit following a looped path and having longitudinally extending segments arranged consecutively in a serpentine configuration along the looped path, each segment having a longitudinal length extending from adjacent the first end of the drum to adjacent the second end of the drum and being subjected to thermal expansion and contraction in longitudinal directions in response to heating and cooling of the conduit resulting from conducting the heated gases along the looped path to provide heat along the interior of the drum;

an inlet coupler coupling the inlet with the source of heated gases for longitudinal movement of the inlet relative to the drum along an inlet site adjacent the source of heated gases; and an outlet connector connecting the outlet to the drum for affixing the outlet against longitudinal movement relative to the drum at an outlet site adjacent one of the first and second ends of the drum;

the conduit being dimensioned, configured and oriented for enabling longitudinal expansion and contraction of the conduit along the longitudinal length of each segment in response to heating and cooling of the conduit, while the outlet remains essentially stationary at the outlet site and any differential longitudinal expansion and contraction between the consecutively arranged segments is accommodated through movement of the inlet in the longitudinal directions.

2. The improvement of claim 1 wherein the conduit includes at least two longitudinally extending segments, the inlet site is located adjacent the first end of the drum, and the outlet site is located adjacent the first end of the drum.

3. The improvement of claim 2 wherein the drum includes a passage extending longitudinally within the drum wall between the first and second ends of the drum, the outlet communicates with the passage adjacent the first end of the drum, and the exhaust communicates with the passage adjacent the second end of the drum such that the passage establishes a further conduit for conducting the heated gases from the outlet to the exhaust.

4. The improvement of claim 2 wherein the heat exchange members comprise tubular heat exchange members arranged in a cylindrical array extending longitudinally along the interior of the drum between the first and second ends of the drum and spaced laterally away from the drum wall, the cylindrical array of tubular heat exchange members providing multiple conduits and corresponding multiple looped paths, each conduit including the at least two longitudinally extending segments arranged serially in a serpentine configuration wherein the two segments are generally parallel to one another along the interior of the drum and are spaced apart radially within the interior of the drum.

5. The improvement of claim 4 wherein the serially arranged segments of each conduit include an upstream segment adjacent a corresponding inlet and a downstream segment adjacent a corresponding outlet, the upstream segment having a first configuration and dimensions and being located on a first circle having a first diameter, and the downstream segment having a second configuration and dimensions different from the first configuration and dimensions, the downstream segment being located on a second circle having a second diameter greater than the first diameter.

6. The improvement of claim 1 wherein the conduit includes at least three longitudinally extending segments extending along the looped path, the inlet site is located adjacent the first end of the drum, and the outlet site is located adjacent the second end of the drum.

7. The improvement of claim 6 wherein the drum includes a passage extending longitudinally within the drum wall between the first and second ends of the drum, the outlet communicates with the passage adjacent the second end of the drum, and the exhaust communicates with the passage adjacent the first end of the drum such that the passage establishes a further conduit for conducting the heated gases from the outlet to the exhaust.

8. The improvement of claim 6 wherein the heat exchange members comprise tubular heat exchange members arranged in a cylindrical array extending longitudinally along the interior of the drum between the first and second ends of the drum, the cylindrical array of tubular heat exchange members providing multiple conduits following corresponding multiple looped paths, each conduit including the at least three longitudinally extending segments arranged serially in a serpentine configuration wherein first and second consecutive ones of the three longitudinally extending segments of each conduit are generally parallel to one another along the interior of the drum and are spaced apart radially within the interior of the drum, and a third consecutive one of the three segments is generally parallel to the first and second ones of the three segments and is spaced circumferentially from the second consecutive one of the three segments.

9. In an indirectly heated asphalt product heater wherein asphalt product is moved longitudinally along the interior of a drum from one to another of longitudinally opposite ends of the drum, the drum having a generally cylindrical drum wall, and heated gases are conducted, through heat exchange members, from a source of heat to an exhaust, each located respectively adjacent a corresponding end of the drum, the heat exchange members extending longitudinally along the interior of the drum between the opposite ends of the drum for isolating the heated gases from the interior of the drum, and consequently from the asphalt product in the drum, while providing heat to the asphalt product within the drum, the improvement wherein the heat exchange members comprise:

a conduit for conducting heated gases from the source of heated gases toward the exhaust, the conduit having an inlet communicating with the source of heated gases and an outlet communicating with the exhaust, the conduit following a looped path and having serial segments, each segment having a longitudinal length extending from adjacent the one end of the drum to adjacent an opposite end of the drum, the segments being arranged consecutively in a serpentine configuration wherein first and second consecutive ones of the segments are generally parallel to one another along the interior of the drum, and are spaced apart radially from one another within the interior of the drum, and are dimensioned, configured and oriented for enabling longitudinal expansion and contraction of the longitudinal length of the conduit in response to heating and cooling of the conduit resulting from conducting the heated gases along the looped path, while accommodating any differential longitudinal expansion and contraction between the consecutively arranged segments through movement of at least one of the outlet and the inlet in longitudinal directions.

10. The improvement of claim 9 wherein the first and second consecutive ones of the segments are spaced laterally away from the drum wall.

11. The improvement of claim 9 wherein the heat exchange members comprise tubular heat exchange members arranged in a cylindrical array extending longitudinally along the interior of the drum between the opposite ends of the drum, the cylindrical array of tubular heat exchange members providing multiple conduits and corresponding multiple looped paths, each conduit including at least three longitudinally extending segments arranged serially, with a third consecutive one of the three segments being spaced circumferentially from the second consecutive one of the three segments and radially away from the drum wall within the interior of the drum.

12. The improvement of claim 9 wherein the drum includes a passage extending longitudinally within the drum wall between the opposite ends of the drum, the outlet communicates with the passage adjacent one end of the drum, and the exhaust communicates with the passage adjacent an opposite end of the drum such that the passage establishes a further conduit for the heated gases between the outlet and the exhaust.

* * * * *